US006676406B2

(12) United States Patent
Suzuki et al.

(10) Patent No.: US 6,676,406 B2
(45) Date of Patent: Jan. 13, 2004

(54) FUEL EVAPORATION APPARATUS AND CATALYTIC COMBUSTION APPARATUS

(75) Inventors: Motohiro Suzuki, Osaka (JP); Tatsuo Fujita, Osaka (JP); Tetsuo Terashima, Neyagawa (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/089,401

(22) PCT Filed: Jul. 26, 2001

(86) PCT No.: PCT/JP01/06435

§ 371 (c)(1),
(2), (4) Date: Jul. 26, 2002

(87) PCT Pub. No.: WO02/10644

PCT Pub. Date: Feb. 7, 2002

(65) Prior Publication Data

US 2003/0022118 A1 Jan. 30, 2003

(30) Foreign Application Priority Data

Jul. 28, 2000 (JP) ..... 2000-228598

(51) Int. Cl.[7] ..... F23D 11/44; F23D 14/12
(52) U.S. Cl. ..... 431/243; 431/328
(58) Field of Search ..... 431/243, 208, 431/328

(56) References Cited

U.S. PATENT DOCUMENTS 5,901,700 A * 5/1999 Suzuki et al. ..... 431/7
5,938,427 A * 8/1999 Suzuki et al. ..... 431/208
5,975,890 A * 11/1999 Kawasaki et al. ..... 431/328
6,386,862 B1 * 5/2002 Fujita et al. ..... 431/170

FOREIGN PATENT DOCUMENTS

| | | |
|---|---|---|
| JP | 05-10508 | 1/1993 |
| JP | 05-44912 | 2/1993 |
| JP | 06-129613 | 5/1994 |
| JP | 06-249414 | 9/1994 |

OTHER PUBLICATIONS

Japanese search report for PCT/JP01/06435 dated Nov. 6, 2001.

English translation of Japanese search report for PCT/JP01/06435 dated Nov. 6, 2001.

* cited by examiner

*Primary Examiner*—Alfred Basichas
(74) *Attorney, Agent, or Firm*—RatnerPrestia

(57) ABSTRACT

There is provided a catalytic combustion apparatus that allows power consumption of a carburetor heater to be significantly reduced, and allows a fuel consumption amount to be reduced. A catalytic combustion apparatus including: a fuel tank 1 for feeding fuel and others, an air feeding fan 5 for feeding air and others, a carburetor 8 for evaporating the above described fuel, a gas mixture space 15 that holds the above described evaporated fuel and the above described air, a catalytic combustion unit 17 adjacent to the above described gas mixture space, and a catalyst heating element 10 provided in the gas mixture space 15, characterized in that the catalyst heating element 10 has a first heating compartment 11 and a second heating element compartment 12 provided from upstream to downstream of a flow of the above described gas mixture, and that the compartments carry catalysts on all or part thereof and are provided with a first gas mixture vent 13 and a second gas mixture vent 14.

16 Claims, 3 Drawing Sheets

FUEL EVAPORATION APPARATUS AND CATALYTIC COMBUSTION APPARATUS

This Application is a U.S. National Phase Application of PCT International Application PCT/JP01/06435.

TECHNICAL FIELD

The present invention relates to a catalytic combustion apparatus or the like using liquid fuel, and more particularly to an evaporation method of liquid fuel, especially an art of reducing power consumption required for evaporation.

BACKGROUND ART

As methods for evaporating liquid fuel, a method for dropping liquid fuel in an evaporation unit for evaporation, a method for evaporating liquid fuel via an evaporation element located in an evaporation unit for injection thereafter, or the like has been used in oil burning appliances for home use and well known.

In any of the methods, heat recovery to the evaporation unit is performed by heat conduction from an evaporation heat recovery ring located at a flame port of formed flame or from an evaporation heat recovery receiving unit disposed with part thereof extending into the flame.

In the above described conventional evaporation apparatus, atmosphere temperature of the formed flame and the vicinity thereof is 1100° C. to 1300° C. and high, so that heat recovery to the evaporation unit performed by the heat conduction from the evaporation heat recovery ring located at the flame port or from the evaporation heat recovery receiving unit disposed with part thereof extending into the flame sometimes allows self heat combustion.

However, in a catalytic combustion apparatus, a catalytic combustion unit has temperature limited to 900° C. or less that is a limit of heat resistance, and is a heat recovery source of lower temperature, so that it is difficult to achieve self heat combustion in a configuration of an evaporation unit like the conventional one, and a heater for continuously heating the evaporation unit is separately required.

However, there is a problem that the heater for heating the evaporation unit requires high power consumption. There is also a disadvantage that uniform heating and evaporation of the liquid fuel is difficult, causing part of the fuel to recondense (to become tar) and deposit in the evaporation unit.

DISCLOSURE OF THE INVENTION

The present invention has the object to provide a fuel evaporation apparatus that solves the problems of the conventional catalytic combustion apparatus and the fuel evaporation apparatus, and that allows evaporation heat to be sufficiently obtained without separate use of a heater for continuously feeding the evaporation heat.

To achieve the above object, one aspect of the present invention is a fuel evaporation apparatus, comprising:

fuel feeding means of feeding liquid fuel;

air feeding means of feeding air;

a carburetor for evaporating said fuel;

an auxiliary catalytic combustion unit provided in contact with or close to said carburetor;

a gas mixture space that is provided between said carburetor and said auxiliary catalytic combustion unit, which holds said evaporated fuel and said air, wherein said auxiliary catalytic combustion unit has a plurality of compartments provided from upstream to downstream of a flow of said gas mixture, and that said compartments carry catalysts on all or part thereof and are provided with gas mixture vents through which said gas mixture passes.

Another aspect of the present invention is the fuel evaporation apparatus according to the 1st invention, wherein said air feeding means feeds the air into said carburetor.

Still another aspect of the present invention is the fuel evaporation apparatus, wherein said air feeding means feeds the air into said gas mixture space.

Yet still another aspect of the present invention is the fuel evaporation apparatus, wherein it comprises an air feeding port opening into said gas mixture, and that said air passes through said carburetor and is fed from said air feeding port into said gas mixture space.

Still yet another aspect of the present invention is the fuel evaporation apparatus, wherein at least one of said compartments has an air diversion port disposed downstream of said air feeding port, and that part of the air fed from said air feeding port passes through said air diversion port to be diverted.

A further aspect of the present invention is the fuel evaporation apparatus, wherein said catalysts are carried on all of said compartments, and that said air diversion ports of said compartments have smaller diameters at more downstream positions along the flow of said gas mixture.

A still further aspect of the present invention is the fuel evaporation apparatus according to the 1st invention, wherein said compartments come into contact with said carburetor at their ends, that among said compartments, the compartment positioned upstream of the flow of said gas mixture is covered with the compartment positioned downstream of the flow of said gas mixture at a predetermined distance, and that said gas mixture passes around said compartment positioned upstream of the flow of said gas mixture.

A yet further aspect of the present invention is the fuel evaporation apparatus, wherein a gas mixture vent of said compartment positioned upstream of the flow of said gas mixture and a gas mixture vent of said compartment positioned downstream of the flow of said gas mixture are provided in such a manner that central axes of said gas mixture vents do not coincide with each other.

A still yet further aspect of the present invention is the catalytic combustion apparatus, wherein the most downstream compartment, or at least a surface thereof facing said catalytic combustion unit is formed from high emissivity base material.

An additional aspect of the present invention is the fuel evaporation apparatus, wherein the most downstream heating element compartment, or at least a surface thereof facing said catalytic combustion unit is coated with base material having high emissivity.

A still additional aspect of the present invention is the fuel evaporation apparatus, wherein said catalyst is carried on parts other than a surface facing said carburetor of the most upstream compartment and a surface facing said catalytic combustion unit of the most downstream compartment.

A yet additional aspect of the present invention is the fuel evaporation apparatus, wherein said compartments are disposed at a distance not more than a quenching distance.

A still yet additional aspect of the present invention is a catalytic combustion apparatus comprising:

the fuel evaporation apparatus, a catalytic combustion unit provided downstream of said auxiliary catalytic combustion unit; and a second gas mixture space that is provided between said auxiliary catalytic combustion unit and said catalytic combustion unit and holds said evaporated fuel and said air.

A supplementary aspect of the present invention is the catalytic combustion unit, wherein a straightening vane disposed to oppose said air diversion port is provided in said second gas mixture space.

The above described present invention provides, as an example, a catalytic combustion apparatus including: a fuel feeding passage for feeding liquid fuel; an air feeding passage for feeding air; a carburetor provided with a heater; a catalyst heating element disposed in contact with or close to the above described carburetor; a gas mixture space provided between the above described carburetor and the above described catalytic heating element; and a catalytic combustion unit having a plurality of communication passages located downstream of the above described catalyst heating element, characterized in that the above described catalyst heating element carries an oxidization catalytic component and includes a plurality of heating element compartments having gas mixture vents, that the above described plurality of heating element compartments are disposed in a flow direction of the gas mixture, and that the gas mixture having passed through an upstream heating element compartment thereby successively passes through a downstream heating element compartment.

A catalytic combustion apparatus according to another embodiment of the present invention is characterized in that an air injection port at a tip of an air feeding passage penetrates a carburetor such that air does not come into contact with the carburetor, that air diversion ports are provided, at downstream positions of the air injection port, in the heating element compartments included in a catalyst heating element, and that air is diverted in such a manner that part of the air passes through the air diversion ports and does not come into contact with the catalyst heating element.

A catalytic combustion apparatus according to a further embodiment of the present invention is characterized in that the most upstream heating element compartment carries an oxidation catalytic component, that the most downstream heating element compartment is formed from high emissivity base material, or that at least surface thereof facing a catalytic combustion unit is coated with high emissivity material, and that the heating element compartments are disposed in contact with a carburetor.

A catalytic combustion apparatus according to a further embodiment of the present invention is characterized in that gas mixture vents are disposed in such a manner that gas mixture having passed through a gas mixture vent of an upstream heating element compartment collides with a downstream heating element compartment.

DESCRIPTION OF REFERENCE NUMERALS

Figure 1:
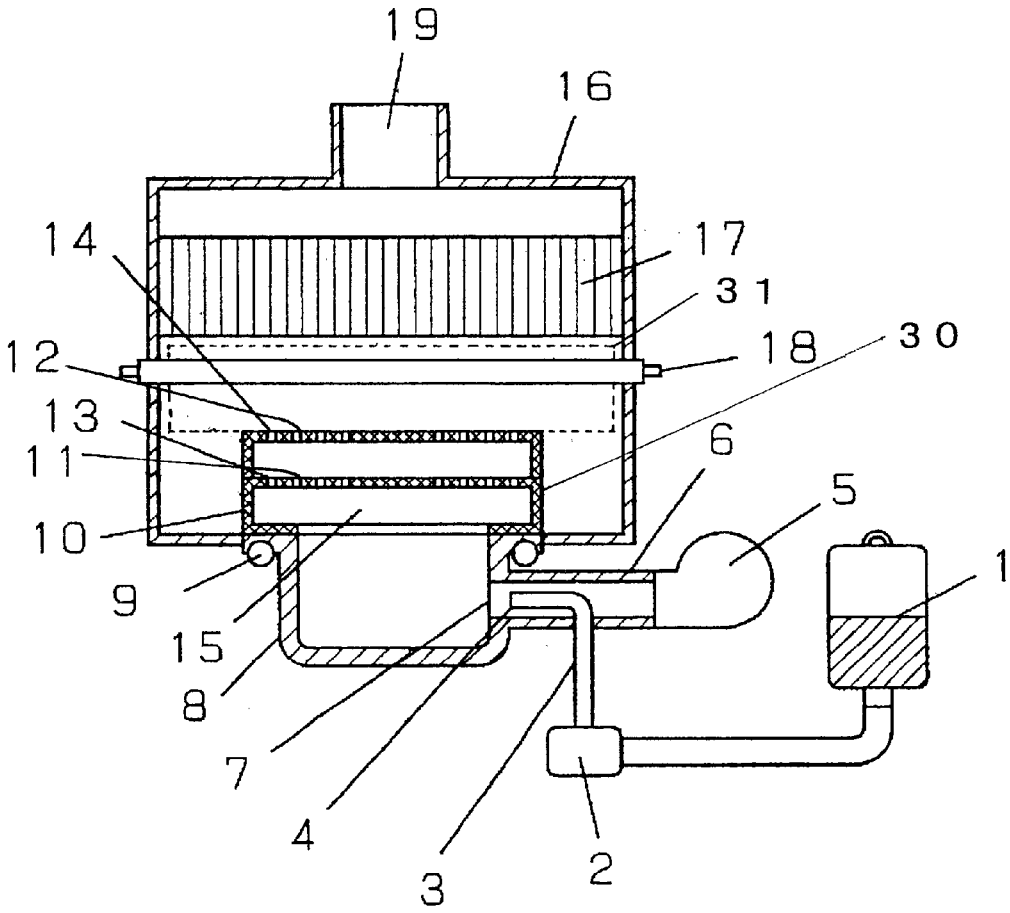
FIG. 1 is a sectional configuration view of part of a combustion apparatus according to a first embodiment of the present invention.

1 fuel tank
2 fuel feeding pump
3 fuel feeding passage
4 fuel injection port
5 air feeding fan
6 air feeding passage
7 air injection port
8 carburetor
9 carburetor heater
10 catalyst heating element
11 first heating element compartment
12 second heating element compartment
13 first gas mixture vent
14 second gas mixture vent
15 gas mixture space
16 combustion chamber
17 catalytic combustion unit
18 catalyst preheater
19 combustion gas exhaust port
20 first air diversion port
21 second air diversion port
22 straightening vane
30 side wall
31 second gas mixture space

BEST MODE FOR CARRYING OUT THE INVENTION

Embodiments of the present invention will be described with reference to the drawings. In the embodiments of the present invention, there needs a catalytic combustion apparatus comprising a catalyst having a large number of through holes and oxidation activity to various kinds of fuel, an carburetor of liquid fuel, an ignition device, a flow rate control device, or a temperature detection device or a drive unit as required.

As a catalytic combustion unit, a honeycomb carrier of metal or ceramic, braided material of ceramic fiber, porous sintered material, or the like, that carries an active ingredient having noble metal such as platinum or palladium as a main ingredient can be used.

A manual needle valve, an electric solenoid valve or the like is used for the control of the flow rate air, and for the liquid fuel, an electromagnetic pump or the like is used. For other driving sections, lever operation by hand or motor driving by automatic control can be performed.

As the ignition device, an electric heater or an electric discharge ignition device can be used.

These means have been widely used, and other known means can be used. Descriptions on details thereof will be herein omitted.

(Embodiment 1)

FIG. 1 is a sectional configuration view of part of a catalytic combustion apparatus according to Embodiment 1 of the present invention.

In FIG. 1, reference numeral 1 denotes a fuel tank; 2, fuel feeding pump; 3, fuel feeding passage; 4, fuel injection port; 5, air feeding fan; 6, air feeding passage; 7, air injection port; and 8, carburetor whose inner surface is coated with heat resisting black paint.

Reference numeral 9 denotes a carburetor heater and reference numeral 10 denotes a catalyst heating element, and the catalyst heating element 10 comprises a first heating element compartment 11 carrying platinum metal as a metal base material and a second heating element compartment 12 connected thereto. The first heating element compartment 11 is provided with a first gas mixture vent 13, and the second heating element compartment 12 is provided with a second gas mixture vent 14. The first heating element compartment 11 is disposed in contact with the carburetor 8, and spaces between the second heating element compartment 12 and the first heating element compartment 11 and between the first heating element compartment 11 and the carburetor 8 are surrounded by a side wall 30 integrated with the second heating element compartment and the first heating element compartment 11 to form a gas mixture space 15. The side wall 30 corresponds to part of an auxiliary catalytic combustion unit of the present invention.

Reference numeral 16 denotes a combustion chamber; 17, catalytic combustion unit that is ceramic honeycomb having a plurality of through holes and carrying platinum metal; 18, catalyst preheater; and 19, combustion gas exhaust port. A second gas mixture space 31 is formed between the catalyst heating element 10 and the catalytic combustion unit 17.

Next, operations and characteristics of the catalytic combustion apparatus of this embodiment shown in FIG. 1 will be described. Liquid fuel (kerosene is used) in the fuel tank 1 is controlled its flow rate by the fuel feeding pump 2, passed through the fuel feeding passage 3, and injected from the fuel injection port 4 into the air feeding passage 6.

Voltage is applied to the air feeding fan 5 for operation to thereby feed air of an appropriate flow rate. The air is passed through the air feeding passage 6 and mixed with the liquid fuel, and injected from the air injection port 7 into the carburetor 8. Gas mixture injected from the air injection port 7 collides with an opposite wall of the carburetor 8 controlled at 250° C. or more by ON-OFF control of the carburetor heater 9, and the liquid fuel evaporates.

The gas mixture including the evaporated liquid fuel passes through the gas mixture space 15 and makes a catalytic reaction with the first heating element compartment 11. Then, the gas mixture flows from the first gas mixture vent 13 into between the first heating element compartment 11 and the second heating element compartment 12, makes a catalytic reaction with catalyst surfaces respectively carried on the first heating element compartment 11 and the second heating element compartment 12, and is then exhausted from the second gas mixture vent 14, and fed to the catalytic combustion unit 17 via the second gas mixture space 31.

At this time, in the catalyst heating element 10, contact frequency of the gas mixture passing between the first heating element compartment 11 and the second heating element compartment 12 with the catalyst surfaces is increased, and further, interchange of radiant heat between opposite surfaces achieves thermal storage, thereby achieving reaction efficiency as high as that of a honeycomb type catalyst, and an appropriate amount of heat without excessive combustion.

Control of a combustion amount by the fuel feeding pump 2 causes upstream temperature of the catalytic combustion unit 17 to be controlled in a range from 500° C. to 900° C. that is a limit of heat resistance, which range provides a satisfactory combustion exhaust gas property and permits continuing combustion. At this time, heat radiation corresponding to 50% to 60% of a combustion amount is performed upstream of the catalytic combustion unit 17. Reaction heat in the catalyst heating element 10 and radiant heat returned from the catalytic combustion unit 17 maintains temperature of the catalyst heating element 10 at 600° C. to 800° C., which is a range suitable for providing evaporation heat.

Further, the reaction heat generated in the first heating element compartment 11 is transmitted to the carburetor 8 by heat conduction from a contact portion with the carburetor 8 and heat radiation from a surface facing the carburetor 8, while the reaction heat generated in the second heating element compartment 12 is transmitted to the carburetor 8 by heat conduction via the first heating element compartment 11. The heat conduction and the radiant heat from the catalyst heating element 10 are also used in preheating of the gas mixture in addition to the evaporation heat of the liquid fuel, and thus returned to the catalytic combustion unit 17 via the catalyst heating element 10.

In this way, returning the reaction heat in the catalyst heating element 10 and the catalytic combustion unit 17 to the carburetor 8 allows power consumption of the carburetor heater 9 required for controlling the carburetor 8 at 250° C. or more to be significantly reduced, and simultaneously, preheating the gas mixture at appropriate temperature allows a fuel consumption amount to be reduced (that is, high heat using efficiency is achieved), thereby providing a catalytic combustion apparatus that is energy efficient and cost efficient.

Further, the present invention performs most of evaporation heat recovery from the catalyst heating element 10 to the carburetor 8, and thus can be also applied to the case where the catalytic combustion unit 17 is not located downstream (that is, a flame combustion apparatus), thereby providing an evaporation apparatus with a wide application range.

In this embodiment, oxidation catalytic components are carried on both surfaces of the first heating element compartment 11 and the second heating element compartment 12, but the oxidation catalytic components may be carried on both surfaces of either of the first heating element compartment 11 or the second heating element compartment 12, or on opposite surfaces only of the first heating element compartment 11 and the second heating element compartment 12. Also in this case, the same advantage as described above can be obtained, and a using amount of expensive noble metal can be reduced, thereby achieving a more cost efficient catalytic combustion apparatus.

(Embodiment 2)

Figure 2:
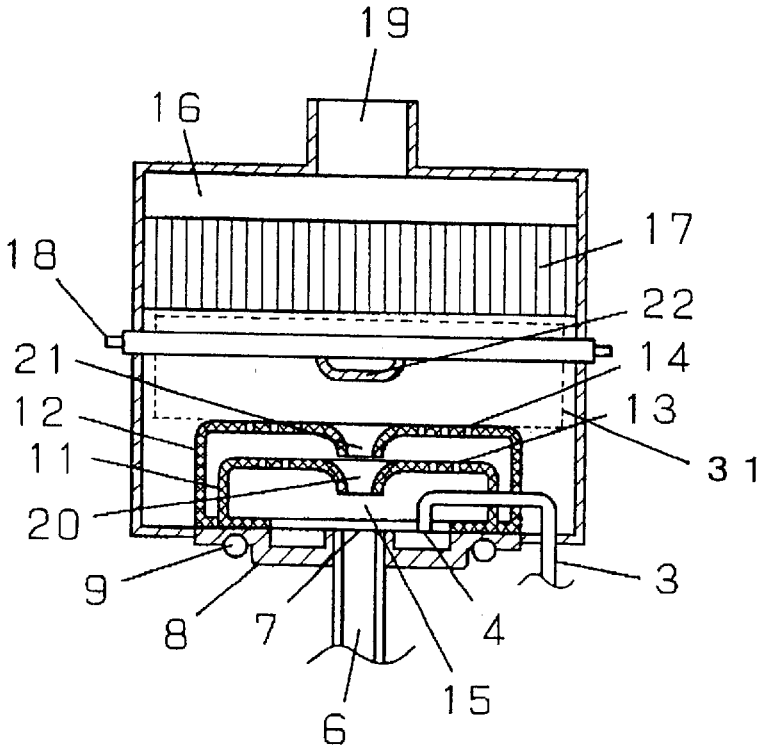
FIG. 2 is a sectional configuration view of essential portions of a combustion apparatus according to a second embodiment of the present invention.

A second embodiment of the present invention will be described. FIG. 2 is a sectional configuration view of essential portions of a combustion apparatus according to this embodiment. In FIG. 2, reference numerals 20, 21 denote a first air diversion port and a second air diversion port located downstream of an air injection port 7, and diverted air passes therethrough. Reference numeral 22 denotes a straightening vane disposed in contact with a catalyst preheater 18.

A basic configuration of this embodiment is identical to that of the Embodiment 1The differences are three: (1) the air injection port 7 penetrates the carburetor 8 such that air does not come into contact with the carburetor 8, and in heating element compartments, air diversion ports are provided at downstream positions of the air injection port 7, and air is diverted in such a manner that part of the air passes through the air diversion ports and does not come into contact with the catalytic combustion unit 17; (2) all heating element compartments (a first heating element compartment 11 and a second heating element compartment 12) are formed into cylindrical shapes, each of them are disposed to come into contact with the carburetor 8 at its edge of the cylinder, and the downstream second heating element compartment 12 is disposed to pass gas mixture entirely around the upstream first heating element compartment 11 and to cover the upstream first heating element compartment 11 at a predetermined distance; and (3) a first air diversion port 20 provided in the upstream first heating element compartment 11 is disposed in such a manner that the gas mixture having passed therethrough collides with the downstream second heating element compartment 12.

Next, operations and characteristics of this embodiment will be described with reference to FIG. 2 and FIG. 3. The air is passed through an air feeding passage 6 and injected from the air injection port 7 at a tip penetrating the carburetor 8 into a gas mixture space 15. Part of the air diverted at the first heating element compartment 11 is not mixed with evaporated fuel, and directly fed from the first air diversion port 20 and the second air diversion port 21 into a combustion chamber 16.

On the other hand, the remaining air passes through the gas mixture space 15 and is mixed with the fuel evaporated by the carburetor 8, and makes a catalytic reaction with the first heating element compartment 11 (a state of air shortage with respect to an appropriate air flow rate). Further, the gas mixture flows from the first gas mixture vent 13 into between the first heating element compartment 11 and the second heating element compartment 12, once collides with the second heating element compartment 12 and is dispersed and mixed, and then makes a catalytic reaction with catalyst surfaces respectively carried on an outer side of the first heating element compartment 11 and an inner side of the second heating element compartment 12. Then, the gas mixture is exhausted from the second gas mixture vent 14, and fed to the combustion chamber 16.

In this way, the second heating element compartment 12 and a side wall 30*a* are disposed to pass the gas mixture entirely around the first heating element compartment 11 to thereby increase a reaction area between the first heating element compartment 11 and the second heating element compartment 12 and increase contact frequency of the flowing gas mixture with the catalyst surfaces, and further, interchange of radiant heat between opposite surfaces achieves thermal storage. Thus, there are achieved reaction efficiency as high as that of a honeycomb type catalyst, and an appropriate amount of heat without excessive combustion.

The diverted air as described above collides with the straightening vane 22 to form a flow toward a gas mixture flow formed around the combustion chamber 16, where the air is mixed with the gas mixture and fed to the catalytic combustion unit 17. At this time, as described above, the gas mixture having passed through the catalyst heating element 10 can restrain an amount of heat radiation to combustion air, and is therefore in the state of air shortage with respect to the appropriate air flow rate. However, reaction heat generated in the catalyst heating element 10 and radiant heat returned from the catalytic combustion unit 17 maintains temperature of the catalyst heating element 10 at 600° C. to 800° C. like Embodiment 1.

Further, the reaction heat generated in the catalyst heating element 10 is transmitted to the carburetor 8 by heat conduction from a contact portion with the carburetor 8 and heat radiation from a surface facing the carburetor 8, of the first heating element compartment 11. The second heating element compartment 12 is disposed to pass the gas mixture entirely around the first heating element compartment 11 to thereby provide a large reaction area and a large amount of heat of each unit.

The conductive heat and the radiant heat from the catalyst heating element 10 are simply used as evaporation heat of the liquid fuel, and an amount of heat separately fed to the carburetor 8 may be reduced by a factor of 8 to 6 of that in evaporation as the gas mixture. Simultaneously, reduction in the flow rate of the gas mixture coming into contact with the catalyst heating element 10 causes reduction in an amount of heat recovery from the catalyst heating element 10 to the gas mixture, and thus power consumption of the carburetor heater 9 required for controlling the carburetor 8 at 250° C. or more throughout all combustion amount areas can be reduced to zero, thereby achieving self heat combustion.

Figure 3:
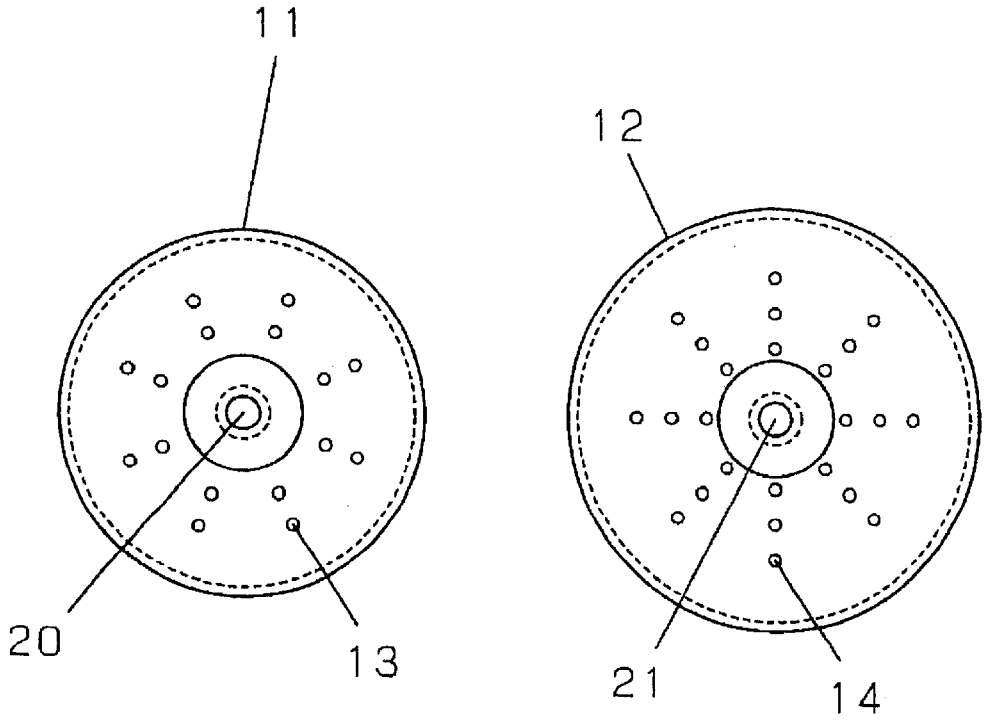
FIG. 3 is a top view of a first and second heating element compartments according to a third embodiment of the present invention.

In the catalytic combustion apparatus of the present invention, as shown in FIG. 3 (a top view of the heating element compartments), the first heating element compartment 11 and the second heating element compartment 12 are preferably disposed with their gas mixture vents displaced from each other in such a manner that the gas mixture having passed through the first gas mixture vent 13 effectively collides with the downstream second heating element compartment. It is because such a configuration allows improvement in a mixed state of the fuel and air in the gas mixture and improvement in reaction with the catalyst, and allows uniform gas mixture to be fed to the catalytic combustion unit 17 even in diversion of air or in a low combustion amount area having a low flow rate. At this time, the first heating element compartment 11 and the second heating element compartment 12 are preferably disposed in such a manner that central axes of their gas mixture vents do not coincide with each other.

In this way, there is achieved a catalytic combustion apparatus that has a satisfactory combustion exhaust gas property, a large variable range of combustion amounts, and high comfortableness.

In this embodiment, oxidation catalytic components are carried on entire surfaces of the first heating element compartment 11 and the second heating element compartment 12, but like Embodiment 1, the oxidation catalytic components may be carried on both surfaces of either of the first heating element compartment 11 or the second heating element compartment 12, or on opposite surfaces only of the first heating element compartment 11 and the second heating element compartment 12. Also in this case, the same advantage as described above can be obtained, and further, a using amount of expensive noble metal can be also reduced, thereby achieving a more cost efficient catalytic combustion apparatus.

In the above described embodiment, the first air diversion port 20 and the second air diversion port 21 has the same diameters, but the diameter of the second air diversion port 21 is preferably smaller than the first air diversion port 20. This can solve the problem that air shortage occurs between the first heating element compartment 11 and the second heating element compartment 12 in the lower combustion amount area to cause the reaction heat to be insufficiently recovered by the carburetor 8, not achieving zero power consumption of the carburetor heater 9 throughout all the combustion areas.

(Embodiment 3)

Figure 4:
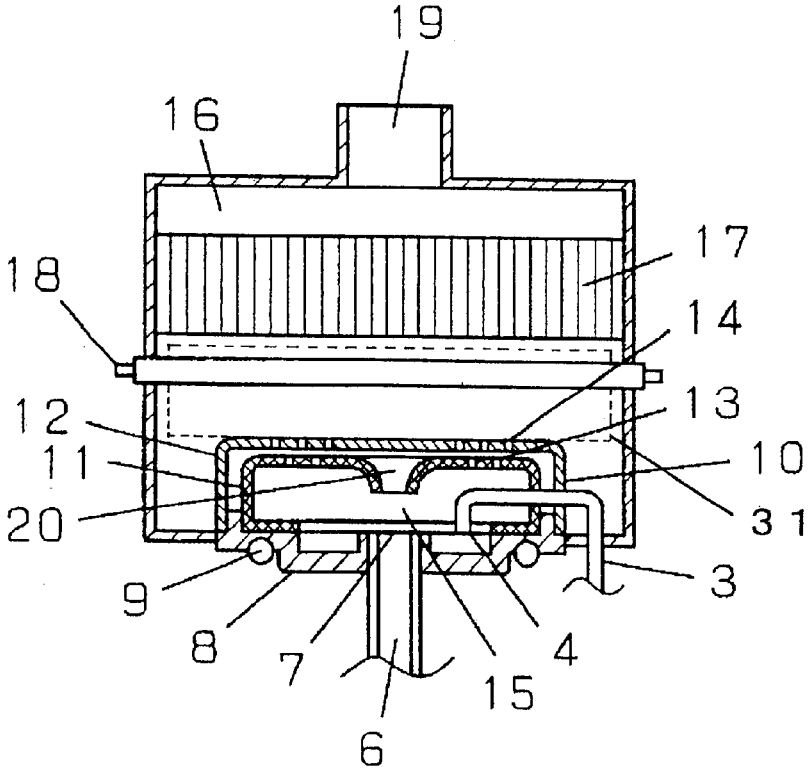
FIG. 4 is a sectional configuration view of essential portions of a combustion apparatus according to a third embodiment of the present invention.

A third embodiment of the present invention will be described. FIG. 4 is a sectional view of essential portions of this embodiment.

In FIG. 4, a first heating element compartment 11 provided with a first air diversion port 20 and a second heating element compartment 12 not provided with an air diversion port are located at a distance not more than a quenching distance (the quenching distance varies among kinds of fuel), and are located, in this embodiment, at a distance of 1.5 mm. The distance varies among the kinds of fuel, but any distance not more than 3.0 mm, through which gas mixture can pass may be possible. The first heating element compartment 11 carries an oxidation catalytic component, and both surfaces of the second heating element compartment 12 are coated with high emissivity material.

A basic configuration of this embodiment is identical to that of the Embodiment 2. The differences are that: (1) the most upstream first heating element compartment 11 carries the oxidation catalytic component, a surface facing a catalytic combustion unit, of the most downstream heating element compartment is coated with high emissivity material, the heating element compartments are disposed in contact with a carburetor, and the heating element compartments are disposed at the distance not more than the quenching distance.

Next, operations and characteristics of this embodiment will be described with reference to FIG. 4. Air passes through an air feeding passage 6 and injected from an air injection port 7 at a tip penetrating a carburetor 8 into a gas mixture space 15, and then part of the air diverted at the first heating element compartment 11 is not mixed with evaporated fuel, and passes through the first air diversion port 20, collides with the second heating element compartment 12, and then flows into a space between the first heating element compartment 11 and the second heating element compartment 12.

The gas mixture flowing from a first gas mixture vent 13 into between the first heating element compartment 11 and the second heating element compartment 12 collides with the second heating element compartment 12 and is mixed with the flowing air, makes a catalytic reaction with a catalyst surface of the first heating element compartment 11, and then is exhausted from the second gas mixture vent 14, and fed to the combustion chamber 16.

In this way, contact frequency of the gas mixture passing between the first heating element compartment 11 and the second heating element compartment 12 with the catalyst surface is increased, and further, interchange of radiant heat between opposite surfaces of the first heating element compartment 11 having temperature increased by reaction heat and the second heating element compartment 12 having absorbed radiant heat from a catalytic combustion unit 17 achieves thermal storage, thereby achieving reaction efficiency as high as that of a honeycomb type catalyst, and an appropriate amount of heat without excessive combustion.

Uniform gas mixture that is sufficiently dispersed and mixed between the first heating element compartment 11 and the second heating element compartment 12 can be fed to the catalytic combustion unit 17, thereby providing a satisfactory combustion exhaust gas property.

The first heating element compartment 11 and the second heating element compartment 12 are located at the distance not more than the quenching distance, so that even if there is a local high temperature area resulting from uneven fuel concentration, ignition that occurs in this area can be restrained.

In this case, the reaction heat generated in the first heating element compartment 11 maintains temperature of the first heating element compartment 11 at 600° C. to 800° C. The temperature of the second heating element compartment 12 that absorbs 90% or more of the radiant heat from the first heating element compartment 11 and the catalytic combustion unit 17 is maintained at 350° C. to 550° C.

Further, the reaction heat generated in the first heating element compartment 11 is transmitted to the carburetor 8 by heat conduction from a contact portion with the carburetor 8 and heat radiation from a surface facing the carburetor 8. The radiant heat from the first heating element compartment 11 and the catalytic combustion unit 17 that is absorbed by the second heating element compartment 12 is transmitted to the carburetor 8 by the heat conduction from the contact position.

The conductive heat and the radiant heat from the catalyst heating element 10 are simply used as evaporation heat of the liquid fuel, and an amount of heat separately fed to the carburetor 8 may be reduced by a factor of 8 to 6 of that in evaporation as the gas mixture.

Simultaneously, reduction in the flow rate of the gas mixture coming into contact with the catalyst heating element 10 by diverting the air causes reduction in an amount of heat recovery from the catalyst heating element 10 to the gas mixture, and thus power consumption of the carburetor heater 9 required for controlling the carburetor 8 at 250° C. or more throughout all the combustion amount areas can be reduced to zero, thereby achieving self heat combustion.

As described above, the present invention provides a catalytic combustion apparatus that requires low running costs and achieves high cost efficiency. Further, the second heating element compartment 12 carries no oxidation catalytic component, so that a using amount of expensive noble metal can be reduced, thereby achieving a more cost efficient catalytic combustion apparatus.

In this embodiment, the first heating element compartment 11 and the second heating element compartment 12 are both disposed in contact with the carburetor 8, but the first heating element compartment 11 may be disposed in contact with the second heating element compartment 12. Also in this case, the same advantage as described above can be obtained. The catalyst heating element 10 has a two part configuration of the first heating element compartment 11 and the second heating element compartment 12, but the same advantage as described above can be obtained by a three or more part configuration.

As described above, the present invention is embodied in the combustion apparatus of the liquid fuel, but not limited to this, the present invention also covers the following cases.

Specifically, in the above description, ceramic honeycomb is used as a carrier of the catalyst, but any material or shape may be allowed if it has a plurality of through holes through which premixture of gas can pass, and for example, sintered material of ceramic or metal, metal honeycomb or metal nonwoven fabric, or braided material of ceramic fiber maybe used. Also, a shape such as a curved shape, cylindrical shape, waved shape or the like as well as a flat shape may be arbitrarily selected in accordance with workability of the material and use.

General active ingredients are platinum noble metal such as platinum, palladium, rhodium, but mixture thereof, other metals, oxide thereof, or mixed composition therewith may be allowed, and active ingredients can be selected in accordance with kinds of fuel or using conditions.

The catalytic heating unit of the embodiments comprises two heating element compartments, and it is more preferable that the catalytic heating unit comprises three or more heating element compartments. Especially, in FIG. 2, the downstream heating element compartment is disposed to cover the upstream heating element compartment, and the air injection port penetrates the carburetor, but both configurations are not necessarily required.

In each of the above described embodiments, the fuel tank 1, the fuel feeding pump 2, and the fuel feeding passage 3 are examples of fuel feeding means of the present invention, the air feeding fan 5 and the air feeding passage 6 are examples of air feeding means of the present invention, the carburetor 8 is an example of the carburetor of the present invention, a space in the carburetor 8 and the gas mixture space 15 are examples of the gas mixture spaces of the present invention, and the second gas mixture space 31 is an example of the second gas mixture space of the present invention. The catalytic combustion unit 17 is an example of the catalytic combustion unit of the present invention, the catalyst heating element 10 is an example of the auxiliary catalytic combustion unit of the present invention, the first heating element compartment 11 and the second heating element compartment 12 are examples of the compartments of the present invention. The first gas mixture vent 13 and the second gas mixture vent 14 are examples of the vents of the present invention.

The first air diversion port 20 and the second air diversion port 21 are examples of the air diversion ports of the present invention.

In the above described embodiments, the liquid fuel is kerosene, but gasoline, methanol, ethanol, or the like may be allowed.

The catalyst of the present invention is platinum metal, but oxide or the like such as Mn, Cu, Co may be allowed.

It is described that the side wall 30 is provided around the carburetor 8, the first heating element compartment 11, and the second heating element compartment 12, and forms the gas mixture space as part of the auxiliary catalytic combustion unit of the present invention, but the compartments of the present invention may be provided to come into contact with an outer wall of the catalytic combustion apparatus.

In Embodiments 1 and 2, the oxidation catalytic components are carried on both surfaces of the first heating element compartment 11 and the second heating element compartment 12, but the oxidation catalytic components may be carried on both surfaces of either of the first heating element compartment 11 or the second heating element compartment 12, or on opposite surfaces of the first heating element compartment 11 and the second heating element compartment 12. That is, the compartment of the present invention may carry the catalyst on all or part thereof. In the above description, "all" means all of a plurality of compartments or an entire part of one compartment, and "part" means one or more compartments of part of the plurality of compartments or part of one compartment.

In the above described embodiment, description is made on the catalytic combustion apparatus, but not limited to the catalytic combustion apparatus, the present invention may be embodied as a fuel evaporation apparatus for evaporating the fuel. For example, omitting the catalytic combustion unit 17 and the catalyst preheater 18 from each of the above described embodiments achieves the fuel evaporation apparatus. Such a fuel evaporation apparatus can be used, for example, in a flame combustion apparatus.

Industrial Applicability

The present invention can provide a fuel evaporation apparatus and a catalytic combustion apparatus that has a high heat using efficiency, a large variable range of combustion amount, and high comfortableness. Further, the present invention can provide a fuel evaporation apparatus and a catalytic combustion apparatus that causes reduction in a using amount of expensive noble metal such as platinum metal and is cost efficient.

What is claimed is:

1. A fuel evaporation apparatus, comprising:

fuel feeding means of feeding liquid fuel;

air feeding means of feeding air;

a carburetor for evaporating said fuel; and an auxiliary catalytic combustion unit provided in contact with said carburetor;

said auxiliary catalytic combustion unit defining a gas mixture space, which holds said evaporated fuel and said air, said auxiliary catalytic combustion unit has a plurality of compartments provided from upstream to downstream of a flow of a gas mixture, at least one of said compartments defining a single continuous wall having a surface extending in a direction substantially perpendicular to the flow of the gas mixture to provide for collisions between said surface of said wall and the gas mixture, and said surface of said wall carrying catalysts on all or part thereof and having gas mixture vents through which said gas mixture passes.

2. The fuel evaporation apparatus according to claim 1, wherein said air feeding means feeds the air into said carburetor.

3. The fuel evaporation apparatus according to claim 1, wherein said air feeding means feeds the air into said gas mixture space.

4. The fuel evaporation apparatus according to claim 3, further comprising an air feeding port opening into said gas mixture, and that said air passes through said carburetor and is fed from said air feeding port into said gas mixture space.

5. The fuel evaporation apparatus according to claim 4, wherein at least one of said compartments has an air diversion port disposed downstream of said air feeding port, and that part of the air fed from said air feeding port passes through said air diversion port to be diverted.

6. The fuel evaporation apparatus according to claim 5, wherein said catalysts are carried on all of said compartments, and that said air diversion ports of said compartments have smaller diameters at more downstream positions along the flow of said gas mixture.

7. The fuel evaporation apparatus according to claim 1, wherein said compartments come into contact with said carburetor at their ends, that among said compartments, the compartment positioned upstream of the flow of said gas mixture is covered with the compartment positioned downstream of the flow of said gas mixture at a predetermined distance, and that said gas mixture passes around said compartment positioned upstream of the flow of said gas mixture.

8. The fuel evaporation apparatus according to claim 1, wherein a gas mixture vent of said compartment positioned upstream of the flow of said gas mixture and a gas mixture vent of said compartment positioned downstream of the flow of said gas mixture are provided in such a manner that central axes of said gas mixture vents do not coincide with each other.

9. The fuel evaporation apparatus according to claim 1, wherein the most downstream compartment, or at least a surface thereof facing said catalytic combustion unit is formed from high emissivity base material.

10. The fuel evaporation apparatus according to claim 1, wherein the most downstream heating element compartment, or at least a surface thereof facing said catalytic combustion unit is coated with base material having high emissivity.

11. The fuel evaporation apparatus according to claim 1, wherein said catalyst is carried on parts other than a surface facing said carburetor of the most upstream compartment and a surface facing said catalytic combustion unit of the most downstream compartment.

12. The fuel evaporation apparatus according to claim 1, wherein said compartments are disposed at a distance not more than a quenching distance.

13. A catalytic combustion apparatus comprising:

the fuel evaporation apparatus according to any one of claims 1 to 12;

a catalytic combustion unit provided downstream of said auxiliary catalytic combustion unit; and a second gas mixture space that is provided between said auxiliary catalytic combustion unit and said catalytic combustion unit and holds said evaporated fuel and said air.

14. The catalytic combustion unit according to claim 13, wherein a straightening vane disposed to oppose said air diversion port is provided in said second gas mixture space.

15. The fuel evaporation apparatus of claim 1 wherein at least one of said compartments is in physical heat conductive contact with said carburetor.

16. The fuel evaporation apparatus of claim 15 wherein the physical heat conductive contact provides sufficient heat transfer between said auxiliary catalytic combustion unit and said carburetor such that a separate evaporation heater is not required.

* * * * *